US005706961A

United States Patent [19]

Morano

[11] Patent Number: 5,706,961

[45] Date of Patent: Jan. 13, 1998

[54] NURSER LINER WITH TEXTURED TABS

[76] Inventor: Emanuel P. Morano, 10 Floyd Dr., Totowa, N.J. 07512

[21] Appl. No.: 317,244

[22] Filed: Oct. 3, 1994

[51] Int. Cl.[6] ..... B65D 30/10

[52] U.S. Cl. ..... 215/11.3; 383/35

[58] Field of Search ..... 215/11.3; 383/35; 493/227, 363, 364, 340; 83/660, 695; 206/554; 428/131, 132, 133, 35.2

[56] References Cited

U.S. PATENT DOCUMENTS

| | | | |
|---|---|---|---|
| 2,197,113 | 4/1940 | Piazze | 383/35 |
| 2,309,710 | 2/1943 | Patterson, Jr. | 2/161.3 |
| 2,460,329 | 2/1949 | Allen et al. | 215/11 |
| 2,624,485 | 1/1953 | Boston | 215/11 |
| 2,859,891 | 11/1958 | Carkin | 215/11 |
| 2,881,935 | 4/1959 | Garred | 215/11 |
| 2,939,598 | 6/1960 | Donleavy | 215/11 |
| 3,148,799 | 9/1964 | Meroney | 220/63 |
| 3,166,220 | 1/1965 | Rabb et al. | 222/107 |
| 3,170,619 | 2/1965 | Repko | 229/62 |
| 3,204,855 | 9/1965 | Boynton et al. | 229/53 |
| 3,224,574 | 12/1965 | McConnell et al. | 383/35 |
| 3,393,861 | 7/1968 | Clayton et al. | 229/53 |
| 3,395,822 | 8/1968 | Donleavy | 215/11 |
| 3,411,698 | 11/1968 | Reynolds | 229/53 |
| 3,441,198 | 4/1969 | Ericson | 229/53 |
| 3,534,901 | 10/1970 | Repko et al. | 229/66 |
| 3,550,839 | 12/1970 | Clayton et al. | 229/55 |
| 3,645,414 | 2/1972 | Barr | 215/11 R |
| 3,762,542 | 10/1973 | Grimes | 206/58 |
| 3,790,017 | 2/1974 | Fitzpatrick et al. | 215/11 E |
| 3,793,791 | 2/1974 | Wooten | 428/133 X |
| 3,795,163 | 3/1974 | Armstrong et al. | 83/660 X |
| 3,871,542 | 3/1975 | Hammer | 215/11 E |
| 3,873,735 | 3/1975 | Chalin et al. | 426/87 |
| 3,979,050 | 9/1976 | Cilia | 383/35 |
| 4,289,250 | 9/1981 | Jordan | 220/260 X |
| 4,370,942 | 2/1983 | Dowding et al. | 83/660 X |
| 4,405,056 | 9/1983 | Patterson | 220/271 |
| 4,509,570 | 4/1985 | Eby et al. | 141/390 |
| 4,524,457 | 6/1985 | Marino | 383/17 |
| 4,549,657 | 10/1985 | Martin | 206/610 |
| 4,694,960 | 9/1987 | Phipps et al. | 206/469 |
| 4,711,359 | 12/1987 | White et al. | 215/11.1 |
| 4,747,701 | 5/1988 | Perkins | 383/33 |
| 4,759,639 | 7/1988 | DeMatteis | 383/7 |
| 4,762,514 | 8/1988 | Yoshida | 493/227 |
| 4,769,126 | 9/1988 | Roen et al. | 206/554 |
| 4,989,732 | 2/1991 | Smith | 206/554 |
| 5,188,235 | 2/1993 | Pierce et al. | 206/554 |
| 5,269,605 | 12/1993 | Nguyen | 206/554 X |
| 5,385,251 | 1/1995 | Dunn | 383/35 X |

*Primary Examiner*—Stephen P. Garbe
*Attorney, Agent, or Firm*—Ohlandt, Greeley, Ruggiero & Perle

[57] ABSTRACT

There is provided a nurser liner having a pair of removable textured tabs for mounting the nurser liner to the rim of a nurser container. The tabs have a textured surface formed by piercing through each tab so that the non-pierced side appears smooth. The tabs have a three segment pattern such that a smooth, non-textured center portion is located between textured portions on either side of the center portion. A plurality of pierced holes go through the tab to form the pattern for improved gripping and handling.

14 Claims, 4 Drawing Sheets

NURSER LINER WITH TEXTURED TABS

BACKGROUND OF THE INVENTION

I. Field of the Invention

The present invention relates generally to liners for nurser bottles. More particularly, the present invention relates to tabs located at one end of a flexible liner, that are designed to facilitate opening the mouth of the liner and mounting of the liner onto a rigid nurser bottle or holder. Furthermore, the particular textured tabs have a tactile feel that improve gripping during opening and mounting of the liner.

Disposable liners for containing liquids have been used with rigid holders in order to allow the use of a clean, sanitary container each time instead of having to wash a reusable bottle which sometimes gives questionable results regarding cleanliness. Typically, a liner is mounted onto a holder by gripping the upper edge of the liner, drawing the edge over an open rim of the holder, and folding the edge downward over the outer surface of the holder. The liner is then filled with a desired liquid and a cover, such as a nursing nipple, may be attached to the holder to close the mouth of the liner.

In order to maintain cleanliness, tabs may be located at the mouth of the liner to provide finger grasp positions. The tabs permit one to firmly grasp the liner to facilitate opening of the mouth of the liner. The tabs also permit one to draw the liner over the rim of the holder. The tabs avoid having the inside of the liner touched by human hands. The tabs may even be adapted to separate from the liner by the use of perforations once the liner has been mounted on the holder.

II. Description of the Prior Art

Liners having a tab or flange at an end portion of the liner are known. For example, U.S. Pat. No. 2,460,329 to A. M. Allen, et al., which issued on Feb. 1, 1949 titledd Nursing Unit; U.S. Pat. No. 2,624,485 to F. E. Boston, which issued on Jan. 6, 1953 titledd Nurser; U.S. Pat. No. 2,859,891 to G. V. Carkin, which issued on Nov. 11, 1958 titled Nursing Bottle; U.S. Pat. No. 2,881,935 to W. P. Garred, which issued on Apr. 14, 1959 titled Infant's Nursing Bottle Assembly; U.S. Pat. No. 3,166,220 to S. W. Rabb, et al., which issued on Jan. 19, 1965 titled Dispensing Holder and Receptacle; and U.S. Pat. No. 3,645,414 to A. C. Barr, which issued on Feb. 29, 1972 titled Nursing Unit With Improved Plastic Liner, all relate to liquid receptacles having flanges at one end. Also, U.S. Pat. No. 2,939,598 to T. J. Donleavy, which issued on Jun. 7, 1960 titled Dispensing Container; U.S. Pat. No. 3,395,822 to T. J. Donleavy, which issued on Aug. 6, 1968 titled Nursing Device; U.S. Pat. No. 3,441,198 to A. E. Ericson, which issued Apr. 29, 1969 titled Flexible Bag For Packaging Food Items; U.S. Pat. No. 3,762,542 to G. S. Grimes, which issued on Oct. 2, 1973 titled Infant Feeding Means; and U.S. Pat. No. 3,871,542 to I. M. Hammer, which issued Mar. 18, 1975 titled Disposable Nursing Container, all provide flanged liners for nursing bottles. In addition, U.S. Pat. No. 3,204,855 to I. D. Boynton, which issued on Sep. 7, 1965 titled Flexible Container, and U.S. Pat. No. 3,790,017 to W. E. Fitzpatrick, et al., which issued on Feb. 5, 1974 titled Nursing Unit, each provide a pair of opposing tabs formed on nursing bottles that are adapted to separate along perforations formed adjacent to the mouth of the liner. However, none of the above patents provides any type of surface enhancement to the tabs to facilitate gripping of the tabs.

There are also known in the art plastic bags having handles or holes formed in the tabs. These bags are not nurser liners and are not suited for mounting on nurser bottles. For example, U.S. Pat. No. 3,873,735 to M. L. Chalin et al., which issued on Mar. 25, 1975 titled Food Package For Heating and Venting; U.S. Pat. No. 4,524,457 to F. J. Marino, which issued on Jun. 18, 1985 titled Cargo Bag With Reinforced Triangular Lifting Panels; U.S. Pat. No. 4,759,639 to R. B. DeMatteis, which issued on Jul. 26, 1988 titled Thermoplastic Bag; and U.S. Pat. No. 4,769,126 to R. M. Roen, et al., which issued Sep. 6, 1988 titled Bottom Gusset Bag Pad Arrangement For Liquid Containers, provide plastic bags having cut-out holes integrally formed in the tabs to improve grip. Also, U.S. Pat. No. 3,148,799 to A. H. Meroney, which issued Sep. 15, 1964 titled Disposable Adjustable Receptacle Liner For Wet Refuse; U.S. Pat. No. 4,509,570 to J. Eby, et al., which issued Apr. 9, 1985 titled Elastic Top Bag; and U.S. Pat. No. 4,747,701 to S. Perkins, which issued May 31, 1988 titled Plastic Liner Bag With Elastic Top and Method of Making, provide flanges designed to be secured over a rim of a container, which flanges are formed by adhering additional material to the flanges or the bags themselves.

Plastic bags having an embossment is provided in U.S. Pat. No. 3,393,861 to W. J. Clayton, et al., which issued Jul. 23, 1968 titled Embossed Thermoplastic Bags; U.S. Pat. No. 3,550,839 to W. J. Clayton, which issued Dec. 29, 1970 titled Doubled Walled Plastic Bag; and U.S. Pat. No. 4,711,359 to L. A. White, et al., which issued Dec. 8, 1987 titled Container Such as a Nursing Container, Having Protection Compartment For Dispensing Member. Various other patents describe textured tear strips for plastic bags having embossed tabs adjacent to the mouths of the bags, such as, U.S. Pat. No. 3,170,619 to J. P. Repko, which issued on Feb. 23, 1965 titled Tear Strip Packaging; U.S. Pat. No. 3,534,901 to J. P. Repko, et al., which issued on Oct. 20, 1970 titled Bag Construction; and U.S. Pat. No. 4,549,657 to A. M. Martin, which issued on Oct. 29, 1985 titled Easily Opened and Reclosable Bag and Apparatus For Making Same.

Several types of other plastic bags have been designed with integrally embossed surfaces adjacent to a mouth of the bag to facilitate the separation of adjacent surfaces at the mouth. For example, U.S. Pat. No. 2,197,113 to T. E. Piazze, which issued Apr. 16, 1940 titled Bag Assemblage, provides a bag for packaging merchandise having two walls and a textured zone, located at an upper portion of each wall, that is indented, corrugated, embossed or roughened in order to facilitate the opening or spreading of the upper portions. Also, U.S. Pat. No. 3,224,574 to A. L. McConnell, et al., which issued on Dec. 22, 1965 titled Embossed Plastic Bag, and U.S. Pat. No. 3,411,698 to W. G. Reynolds, which issued Nov. 19, 1968 titled Bag-Like Container Means, provide embossing of the walls of a bag for packaging food products to facilitate the grasping and separating of the walls.

There is a nurser bottle product distributed by Munchkin Bottling, Inc. of Van Nuys, Calif., that has a nurser liner with embossed tabs and with half-circular finger holes in the middle portion of each tab. Such nurser bottle product is also provided in U.S. Pat. No. 5,385,251 to S. B. Dunn, which issued on Jan. 31, 1995, titled Disposable Bottle Bags For Use With Infant Nursing System. However, these embossed tabs have poor gripping surfaces and, thus, appear to require the finger holes to provide an adequate grip. The combination of these two features obviously makes manufacturing more time consuming and, therefore, costly.

Furthermore, embossing the tabs, as well as the addition of finger holes, hinders one's capability to open the mouth of the liner. For example, the liner's mouth may be opened by gripping the middle portion of each tab between one's finger and thumb and sliding them past one another. This process distorts the mouth of the liner and separates the tabs so that each tab may be gripped by each hand of a person. By embossing the tabs, the friction between the adjacent surfaces of each tab increases so that it is more difficult to slide the tabs past one another. Also, the creation of finger holes in the tabs reduces available surface area and, particularly, the most convenient surface of the tabs to grip, i.e., the middle portion. Thus, a finger hole further hinders opening of the liner and mouth.

SUMMARY OF THE INVENTION

Against the foregoing background, it is a primary object of the present invention to provide a flexible liner having a pair of tabs with each tab having a textured surface.

It is another object of the present invention to provide such a flexible liner in which each tab has a textured surface formed by pierced holes through the tab.

It is a further object of the present invention to provide such a flexible liner in which each tab has an improved gripping surface over an embossed tab.

It is still further object of the present invention to provide such a flexible liner in which each tab has a unique pattern on the textured surface.

It is still another object of the present invention to provide such a flexible liner in which the unique pattern is formed by piercing a pair of portions, thereby forming a plurality of piercings or holes on either side of a middle portion.

It is yet another object of the present invention to provide such a flexible liner in which the middle portion of a textured surface of one tab is smooth to provide minimal friction so that the pair of tabs separates easily.

To accomplish the foregoing objects and advantages, the present invention, in brief summary, comprises a plurality of ruptured areas formed by piercing through the tab such that the plurality of ruptured areas forms a tactile surface to facilitate gripping of the tab.

More specifically, the present invention comprises a textured tab of a liner that includes a first side having a virtually smooth surface, and a second side positioned opposite the first side. The second side has a plurality of ruptured areas formed by piercing the tab from the first side through the second side. The plurality of ruptured areas forms a tactile or textured surface to facilitate gripping the tab.

BRIEF DESCRIPTION OF THE DRAWINGS

The foregoing and still further the objects and advantages of the present invention will be more apparent from the following detailed explanation of the preferred embodiments of the invention in connection with the accompanying drawings.

DETAILED DESCRIPTION OF THE PREFERRED EMBODIMENTS

Figure 1:
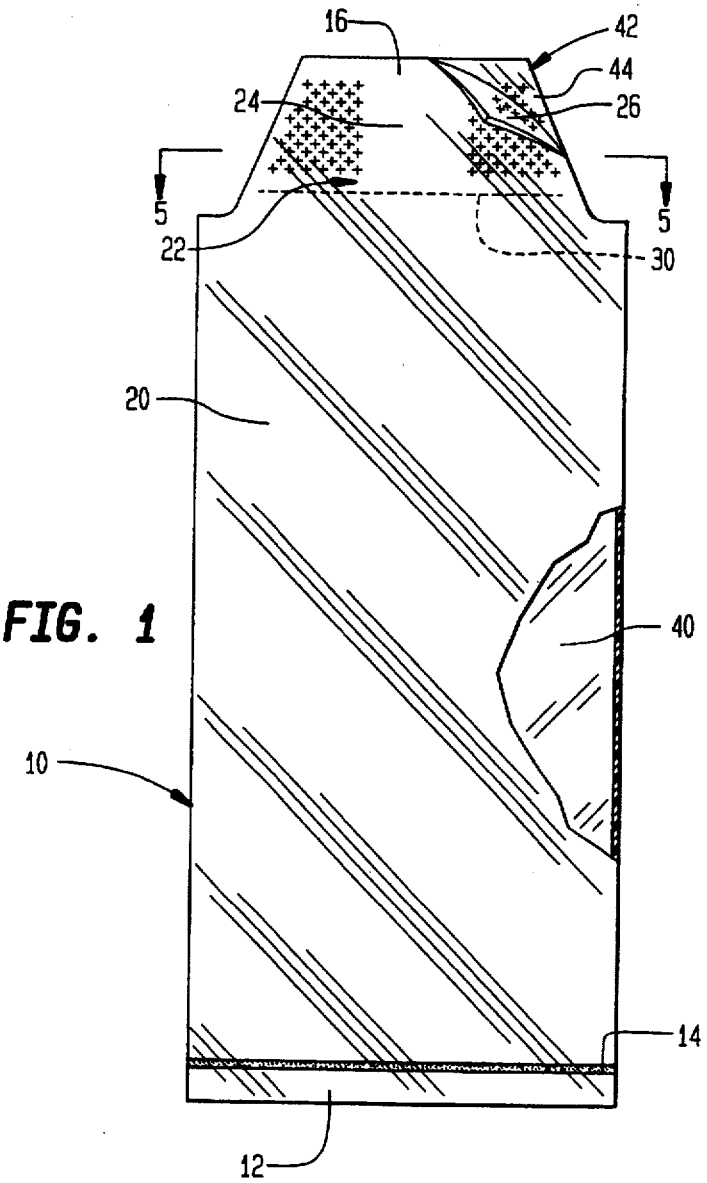
FIG. 1 is a planar view of a flexible liner of the present invention.

Referring to the drawings and, in particular, to FIG. 1, there is provided a flexible liner of the preferred embodiment which is generally represented by reference numeral 10. The liner 10, preferably, has a tubular shape that can be collapsed or flattened so that it may be packaged in roll form for transport and handing. The liner 10 has a bottom end 12 that is heat sealed along a strip 14. Strip 14 is, preferably, offset from the bottom edge of the liner 10. In the flattened state, shown in FIG. 1, each liner has two sides, namely a first side 20 having a tab 22, and a second side 40 having a tab 42.

Each tab 22, 42 is located at a top end 16 of the liner 10 and, preferably, has a trapezoidal shape such that the left side of the tab is substantially symmetrical to the right side of the tab. Each tab 22, 42 has a first surface 24, 44 and a second surface 26, 46 opposite the first surface. Also in the preferred embodiment, a tab perforation 30 is provided at the base of each tab 22, 42 to facilitate removal of the tabs after they have served their primary purpose described below.

Figure 2:
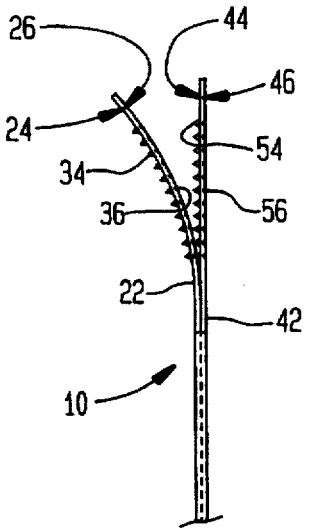
FIG. 2 is a sectional view of the liner of FIG. 1, in which one tab is curved away from the other tab.
Figure 4:
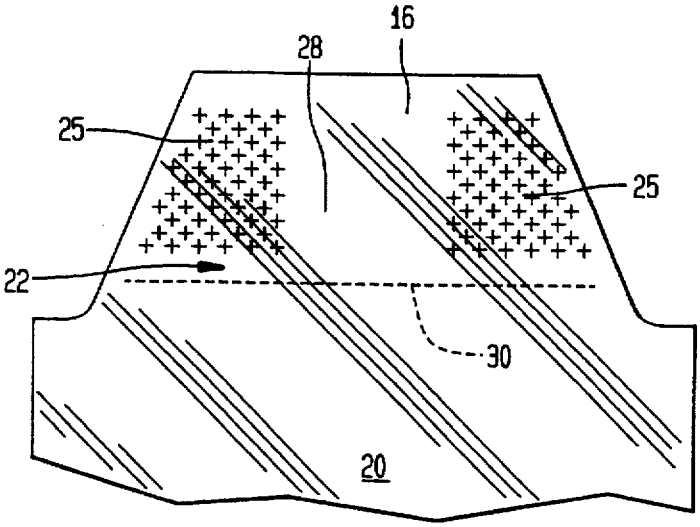
FIG. 4 is an enlarged view of a tab of the liner of FIG. 1.

In the preferred embodiment, the first surfaces 24, 44 of tabs 22, 42 are textured and have a tactile feel, whereas the second surfaces 26, 46 have a non-tactile feel. As shown in FIGS. 1, 2 and 4, a textured surface 44 is positioned adjacent a non-textured surface 26 when the liner 10 is in its collapsed or flattened form.

Referring to FIG. 2, in particular, tabs 22, 42 have a plurality of protuberances 34, 54 on their first, textured surfaces 24, 44 and plurality of penetrated depressions 36, 56 on their second, non-textured surfaces 26, 46. The protuberances 54 of one tab 42 correspondingly mate with the depressions 36 on the other tab 22 when the liner 10 is in its collapsed or flattened form. As shown in FIG. 2, the texture of the first surfaces 24, 44 remain even when the tabs 22, 42 are separated from each other.

Figure 3:
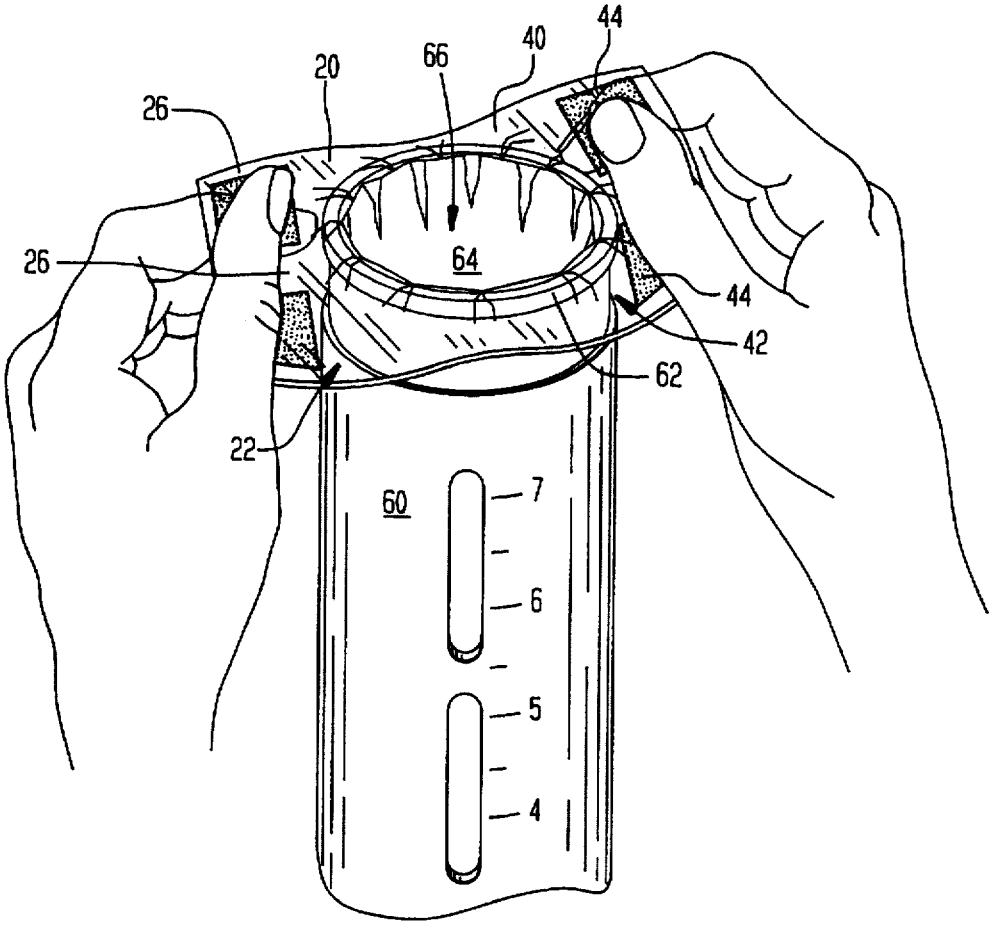
FIG. 3 is a perspective view of the liner of FIG. 1, in which the flexible liner is positioned partially in a rigid holder.

Referring to FIG. 3, the operation of mounting the liner 10 of the preferred embodiment to a rim 62 of a rigid holder 60 is shown. First, the liner 10 is inserted down into the interior 64 of the holder 60 through an open end 66. Tab 22 of the liner 10 is grasped by a thumb and finger of one hand while tab 42 is, likewise, grasped by the other hand. Next, the two tabs 22, 42 are drawn apart and pulled down over the rim 62 at the open end 66. A force that is strong enough to stretch the liner 10 beyond the dormant form of the holder 60 is required. Accordingly, the tabs 22, 42 must provide the best possible grip in order to facilitate this attachment process. The liner 10 is drawn downward over the outer periphery of the rim 62 of the holder 60 until the lower portion of the liner 10 is secured to the holder, just below the tab perforation 30. In the preferred embodiment, the tabs 22, 42 are then pulled and, thus, removed from the liner 10.

FIG. 4 is an enlarged view of the tab 22 of FIG. 1. The other tab 42 (shown in FIGS. 1 through 3) is directly behind tab 22 but is not shown in FIG. 4. Both tabs 22, 42 of the preferred embodiment have a tactile surface 24, 44 and a smooth or non-tactile surface 26, 46. Each surface 24, 26, 44 is dimensionally large enough to accommodate a human finger or thumb for gripping.

Each tactile surface 24, 44 has a pair of pierced portions or sections or segments 25 separated by a smooth portion or section or segment 28. The smooth portion 28 is provided in order to facilitate the separation of tabs 22, 42. Initially, the tactile surface 44 of tab 42 is attached to the non-tactile surface 26 of tab 22 (shown in FIG. 1) due to the pierce-through manufacturing technique of forming the surfaces. Specifically, the pierced portion 25 of tactile surface 44 of tab 42 is mated to non-tactile surface 26 of tab 22. In order to release and separate the tactile surface 44 of tab 42 from tab 22, a thumb is, preferably, placed on the smooth portion 28 and a finger is placed on the non-tactile surface 26 of the tab, thereby grasping the two sides or surfaces of the tab between the thumb and finger. By sliding one surface against the other, preferably by shifting the positions of the thumb and finger, the tactile surface 44 &tab 42 separates from the non-tactile surface 26 of tab 22 as shown in FIG. 3.

The tabs 22, 42 are provided in order to facilitate the application of the top end 16 of the liner 10 onto the open end 66 of the holder 60. As explained above, the tab 22 of the liner 10 is pulled out and over the rim 62 of the open end 66 by simultaneously grasping the tabs 22, 42. The tactile surfaces 24, 44 of the tabs 22, 42 permit a human finger to better grip those surfaces tightly in order to complete the mounting operation. The rougher, higher friction surface or more tactile surface provided by the present liner is desirable since such a surface would enhance the ability of a finger to hold onto the tab.

It has been found that the pierce-through manufacturing technique of the present invention provides a rougher, higher friction surface than the embossment techniques described in the prior art.

Figure 5:
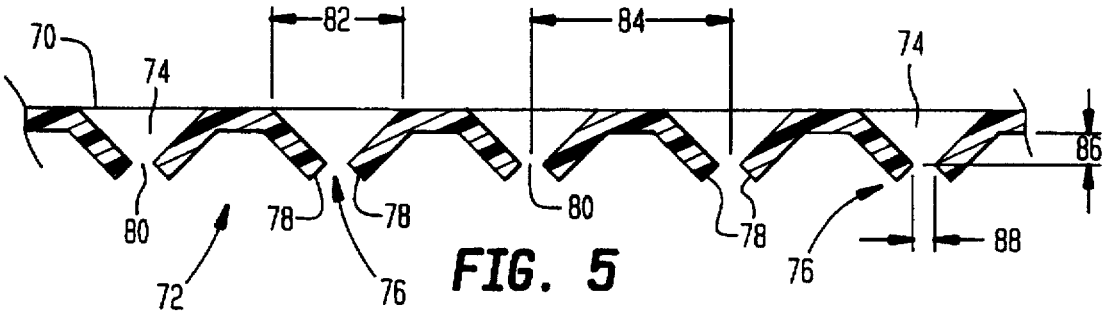
FIG. 5 is a cross-sectional view of a row of holes of the tab taken along line 5—5 of FIG. 1.
Figure 6:
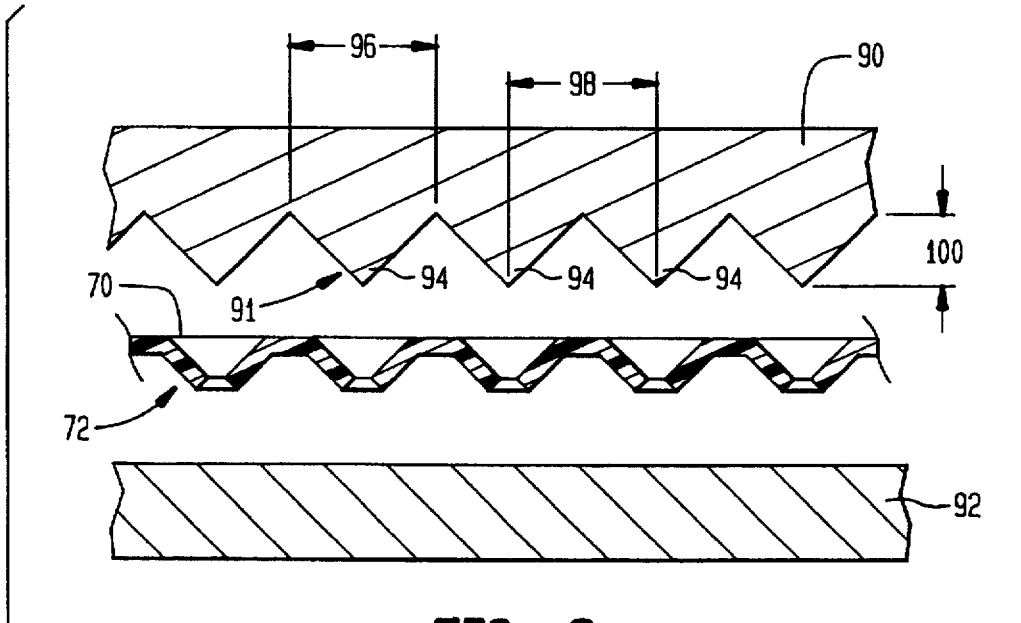
FIG. 6 is a schematic illustrating the formation of the row of holes of FIG. 5.

The technique for producing the high friction characteristic of the tabs 22, 42 of the present invention is to pierce through the entire thickness of the tab. The preferred method for making each tab 22, 42 is shown in FIGS. 5 and 6. As shown in FIG. 6, the tabs 22, 24 are positioned between an upper tool 90 and a lower tool 92. In the preferred embodiment, the upper tool 90 has a piercing edge 91. The upper tool 90 is moved downward to just touch against lower tool 92 and, thus, the piercing edge 91 pierces tabs 22, 24. The tools 90, 92 can also be pressed together by either or both moving towards each other. Also, either tool can have a piercing edge 91. The piercing edge 91 can be any conventional cutting tool having a plurality of piercing or toothed elements. However, the piercing edge 91 needs to be hardened to a minimum value of approximately 40 to 45 $R_c$ using an appropriate hard substance, such as steel, to help maintain a uniform pattern with consistent piercing capability.

In the preferred embodiment shown in FIG. 6, only one piercing edge 91 is needed and desired. Specifically, the upper tool 90 has the piercing edge 91 whereas as the lower tool 92 is simply a base planar surface. In contrast, embossing requires that both upper and lower tools be carefully structured and aligned to mesh perfectly with each other. Furthermore, embossing causes a strong bond between the two tabs that is more difficult to overcome when the tabs are to be separated.

To form the tactile surface 24, the piercing edge 91 enters the non-tactile surface 26 and pierces through the tab 22, 42 and out the tactile surface 24, 44 to just touch the lower tool 92. Too much pressure will cause the piercing edge 91 to press against the lower tool 92 causing the piercing edge 91 to dull quickly. The tactile feel on tactile surface 24, 44 is due to the tips of the piercings or holes. As shown in FIG. 5, the smooth surface 70 of the textured surface 24 is substantially planar and has occasional gaps 74 therein. The rough surface 72 of the textured surface 24 has ruptured areas 76 that are raised and tactile due to the rough edges 78 of the ruptured areas around pierced holes 80. Each ruptured area 76 has a substantially rectangular base 200 formed at the smooth surface 70. The gaps 74 contract to form a virtually smooth or non-textured surface once the piercing edge 91 is removed from the tabs 22, 42. Significantly, other textured products described in the prior art have embossed surfaces that feel smooth, and not tactile, because they do not provide the toughened tactile surface formed by the pierce through tabs of the present invention.

The piercing edge 91 of the upper tool 90 has a plurality of teeth 94. Each tooth 94 has a width 96 between about 0.015 inches and about 0.250 inches, and the teeth 94 are located at intervals 98 between about 0.015 inches and about 0.250 inches from each other. The height 100, as measured from the base to the tip of each tooth 94, ranges from about 0.005 inches to about 0.125 inches. For the preferred embodiment, the dimensions about the teeth 94 include a width 96 about 0.040 inches, a location at intervals 98 about 0.040 inches and a height 100 of 0.020 inches, i.e., of microscopic proportions.

Accordingly, for the preferred piercing edge 91, the dimensions of the ruptured areas 76 of the tactile surfaces 24, 44 are as follows: the width 82 of each ruptured area 76 is between about 0.005 inches and about 0.100 inches, and the interval 84 at which the ruptured areas are situated from each other is between about 0.015 inches and about 0.250 inches. Also, the height 86 as measured from the rough surface 72 to each pierced hole 80 ranges from about 0.001 inches to about 0.050 inches. Each individual hole 80 is no larger than about 0.030 inches in diameter 88. The recommended dimensions of the ruptured areas 76 are a width 82 about 0.028 inches, intervals 84 about 0.040 inches, height 86 about 0.003 inches and hole size 88 that is about 0.005 inches in diameter, i.e., of microscopic proportions. It is believed that the above recommended width 82 and interval 84 may vary by about ±0.005 inches, and the height 86 and hole size 88 may vary by about ±0.002 inches.

Figure 7:
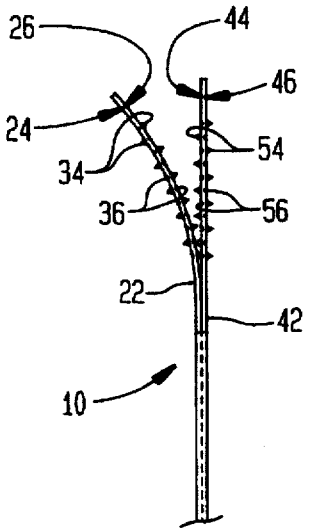
FIG. 7 is a sectional view of a second embodiment of the flexible liner of the present invention.

An alternative or second embodiment of the present invention is shown in FIG. 7. For this embodiment, the protuberances 34, 54 alternately project from the first surfaces 24, 44 and the second surfaces 26, 46 so that both surfaces of the tabs 22, 42 are textured and provide a tactile feel. Similarly, the depressions 36, 56 are positioned alternately between the protuberances 34, 54.

The tabs 22, 42 of the liner 10 may be pierced from both sides in order to form the dual textured surfaces of this second embodiment. The profile of the piercing edge would be similar to the profile of piercing edge 91 shown in FIG. 6. The difference would be that one piercing edge 91 would be situated above the tab surface and would pierce downward toward the tab surface while a second piercing edge (not shown) would be situated below and pierce upward in order to produce the dual-sided tactile feel. This second embodiment is believed to be not as desirable since it will be more difficult to separate the pair of tabs 22, 42 prior to use.

Figure 8:
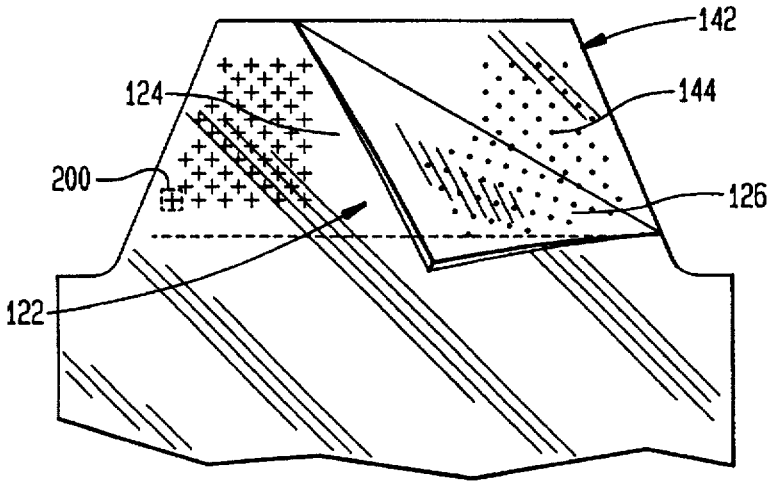
FIG. 8 is a planar view of a third embodiment of the flexible liner of the present invention.
Figure 9:
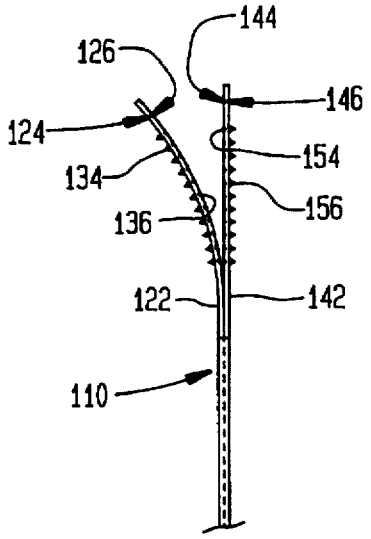
FIG. 9 is a sectional view of the liner of FIG. 8.

Referring to FIGS. 8 and 9, there is shown yet another or third preferred embodiment of a flexible liner 110 of the present invention. Each tab 122, 142 has a textured surface 124, 146 and a non-textured surface 126, 144. However, in this third embodiment, the non-textured surfaces 126, 144 are positioned adjacent to each other when the liner 110 is in its collapsed or flattened form. In particular, the depressions 136 of one tab 122 are correspondingly positioned adjacent to the depressions 154 on the other tab 142.

FIG. 9, in particular, shows that tabs 122, 142 have a plurality of protuberances 134, 156 on their outer textured surfaces 124, 146 and plurality of penetrated depressions 136, 154 on their inner non-textured surfaces 26, 46. In contrast to the preferred embodiment, the separation of the tabs 122, 142 is facilitated, and essentially effortless, for this third embodiment since non-textured surfaces 126, 144 are not attached. In addition, both textured surfaces 124, 146 of the tabs 122, 142 are accessible for gripping when separating the tabs.

Also in contrast to the preferred embodiment, the tabs 122, 142 provide a consistent and balanced grip for mounting the liner 110 to a rim 62 of a rigid holder 60. As described above for the mounting operation, one tab 122 is grasped between a thumb and finger of one hand while the other tab 142 is, likewise, grasped by the other hand. For the preferred embodiment, the textured surfaces 24, 44 are grasped by the finger of one hand and the thumb of the other hand. Thus, the grips of the two hands are inconsistent, unbalanced and perhaps even awkward. The third embodiment provides a consistent and balanced grip by permitting a finger of both hands to grasp the textured surfaces 124, 146 and the thumbs to grasp the non-textured surfaces 126, 144.

However, even with its advantages, this third embodiment is believed to be not as desirable as the preferred embodiment due to the necessity and inconvenience of piercing each tab 122, 142 from the inner portion of the liner 110.

Figure 10:
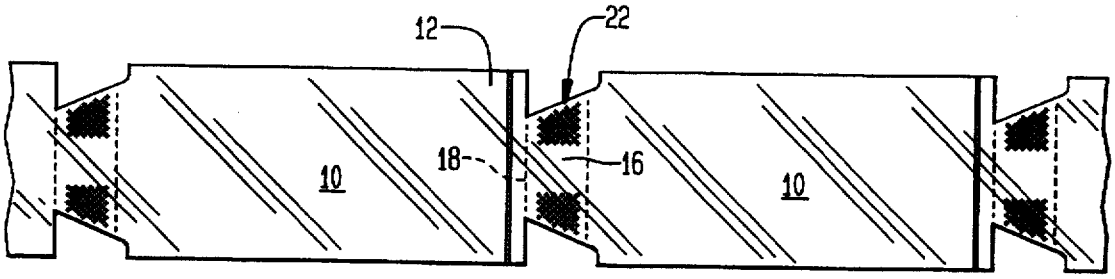
FIG. 10 is a planar view of a plurality of liners of FIG. 1.

Referring to FIG. 10, there is shown a plurality of liners 10 of that have been manufactured. The liners 10 form a continuous strip. The liners 10 are connected such that the top end 16 of one liner is continuous with the bottom end 12 of another liner. The liners 10 are transversely perforated at predetermined intervals at liner perforations 18 to facilitate the detachment of individual liners from the strip. Also, tab perforations 30 are formed across the width of the liners 10 at positions that separate the tabs 22 from the liners to facilitate the detachment of individual tabs.

The material for the liner 10 may be any type of thin sheet or film of elastomeric material, such as polyolefin resins and blends, suitable for the features described herein and may be pierced by the cutting tool. The group of polyolefin resins and blends includes Low Density Polyethylene (LDPE), Linear Low Density Polyethylene (LLDPE), Medium Density Polyethylene (MDPE), High Density Polyethylene (HDPE), Polypropylene (PP) and Ethylene-Vinyl Acetate (EVA) or other rubber or plastic materials that provide suitable strength in thin walled liner form. The preferred material is a polyethylene resin.

The invention having been thus described with particular reference to the preferred forms thereof, it will be obvious that various changes and modifications may be made therein without departing from the spirit and scope of the invention as defined in the appended claims.

Wherefore, we claim:

1. A flexible liner used in a holder, said liner including a tab comprising:

a single surface having two or more textured areas separated by a smooth area, each of said two or more textured areas being formed of a plurality of adjacent ruptures that are formed by piercing through the tab, wherein said single surface facilitates gripping of the tab.

2. A flexible liner used in a holder, said liner including a tab comprising:

a first side having a virtually smooth surface; and a second side opposite said first side, said second side having a single surface with two or more textured areas separated by a smooth area, each of said two or more textured areas being formed of a plurality of adjacent ruptures that are formed by piercing the tab from said first side through said second side, wherein said single surface facilitates gripping of the tab.

3. The flexible liner of claim 2, wherein said plurality of ruptures are all substantially the same height.

4. The flexible liner of claim 2, wherein each of said two or more textured areas forms a substantially uneven surface.

5. The flexible liner of claim 2, wherein each of said plurality of adjacent ruptures has a substantially rectangular base formed at said first side.

6. The flexible liner of claim 2, wherein each of said plurality of adjacent ruptures has a maximum width of between about 0.005 inches and about 0.100 inches.

7. The flexible liner of claim 2, wherein said plurality of adjacent ruptures are located apart from each other at intervals of between about 0.015 inches to about 0.250 inches.

8. The flexible liner of claim 2, wherein each of said plurality of adjacent ruptures has a pierced hole located in a middle portion of said rupture, away from said second side.

9. The flexible liner of claim 8, wherein said pierced hole has a maximum diameter no greater than about 0.030 inches.

10. The flexible liner of claim 8, wherein said pierced hole is located between 0.005 inches and about 0.020 inches away from said second side.

11. A flexible liner for mounting on a rigid holder, the liner having a tubular shape that is normally flattened for transport and handling, the liner comprising:

a closed bottom;

an open top located opposite the bottom; and at least one tab, wherein said tab comprises:

a first side having a virtually smooth surface;

a second side opposite said first side, said second side having a single surface with a plurality of textured areas separated by a contiguous smooth area, each of said plurality of textured areas being formed of a plurality of adjacent ruptures, said plurality of ruptures being formed by piercing the tab from said first side through said second side; and wherein each of said plurality of textured areas and said smooth area on said second side are dimensioned to accommodate one finger of a human's hand to facilitate gripping of the tab.

12. A flexible liner for mounting on a rigid holder comprising:

a liner body; and at least a pair of tabs, removably secured to the liner body, each tab having a first side having a virtually smooth surface and a second side opposite said first side, said second side having a single surface with a plurality of textured areas separated by a contiguous smooth area, each of said plurality of textured areas being formed of a plurality of adjacent ruptures, wherein each rupture is formed by piercing through the tab from said first side through said second side, wherein each of said plurality of textured areas and said smooth area on said second side for each tab are dimensioned to accommodate one finger of a human's hand to facilitate gripping of the tab.

13. The flexible liner of claim 12, wherein said plurality of textured areas of one tab is adjacent said plurality of textured areas of the other tab.

14. A flexible liner used in a holder, said liner including a tab comprising:

a first side having a plurality of first ruptures;

a second side opposite said first side, said second side having a plurality of second ruptures;

said plurality of first ruptures being formed by piercing the tab from said second side through said first side, and said plurality of second ruptures being formed by piercing the tab from said first side through said second side;

wherein said plurality of first ruptures and said plurality of second ruptures facilitate gripping of the tab.

* * * * *